United States Patent [19]

McArthur

[11] 4,159,107

[45] Jun. 26, 1979

[54] ELASTOMER FORCE TRANSMITTER

[75] Inventor: Alexander D. McArthur, Oakville, Canada

[73] Assignee: Persista, Inc., Brampton, Canada

[21] Appl. No.: 925,235

[22] Filed: Jul. 17, 1978

[51] Int. Cl.[2] ..... B25B 1/20

[52] U.S. Cl. ..... 269/224; 269/48.1; 269/254 R; 269/266

[58] Field of Search ..... 269/266, 267, 20, 27, 269/254 R, 48.1, 224

[56] References Cited

U.S. PATENT DOCUMENTS

| | | | |
|---|---|---|---|
| 1,453,176 | 4/1923 | Perrine | 269/266 |
| 2,285,295 | 6/1942 | Martindell | 269/224 |

*Primary Examiner*—Robert C. Watson

*Attorney, Agent, or Firm*—Cullen, Sloman, Cantor, Grauer, Scott & Rutherford

[57] ABSTRACT

A clamping device for holding a regularly or irregularly-shaped part on a work table for machining and work operations. The clamping device has a substantially solid housing with an interior cavity filled with an essentially non-compressible elastomeric material. A disk-like pressure plate abuts a surface of the elastomeric material, and a plurality of sleeves are formed in the housing which extend radially outwardly of the interior cavity of the housing. A plurality of equally sized plungers are slidable in the sleeves that are formed as part of the housing. Pressure and movement exerted by the pressure plate against the elastomeric material is transmitted into radially outward extension of the plungers relative to the housing. Flexible extender tubes are mounted onto the clamp plungers, and they are substantially filled with elastomeric material and have part-engaging plungers at one end. When the clamp plungers are extended radially outwardly, the part-engaging plungers are likewise extended outward from the extender tubes.

3 Claims, 3 Drawing Figures

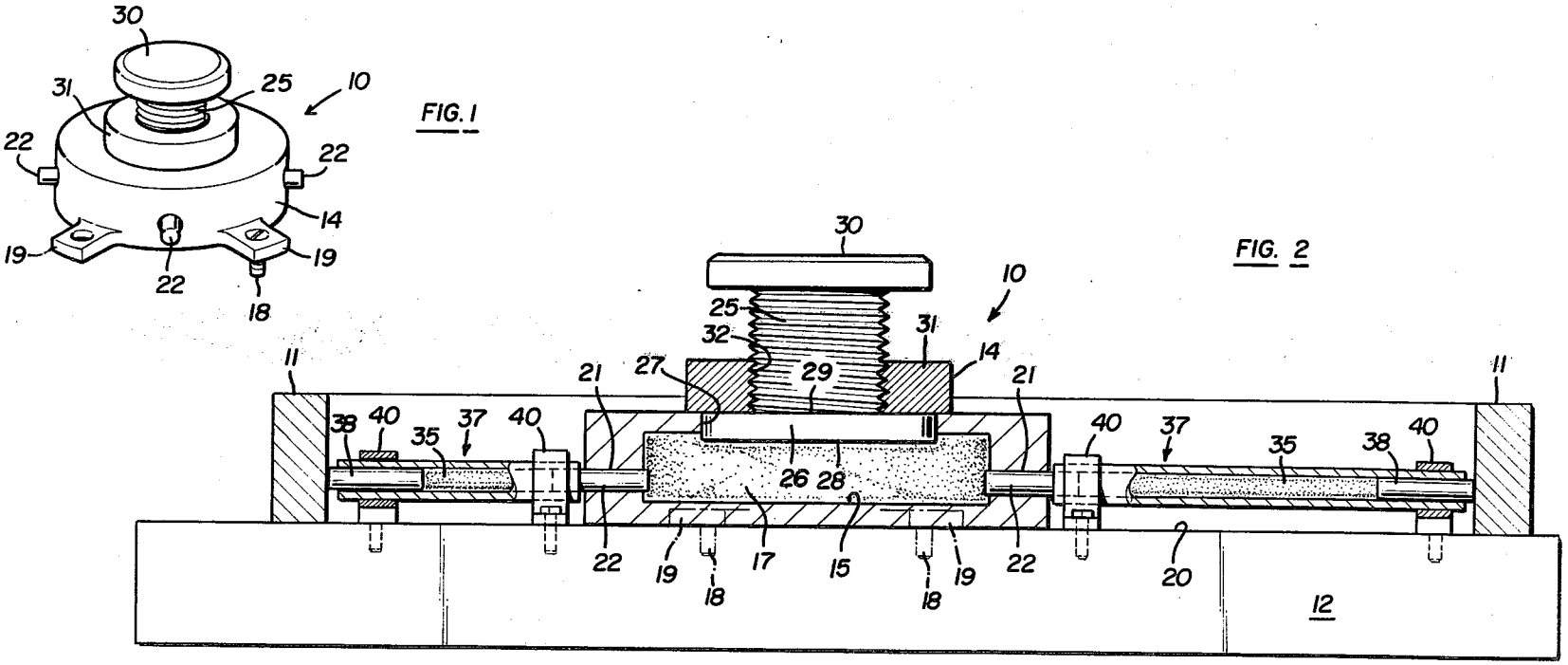
FIG. 2
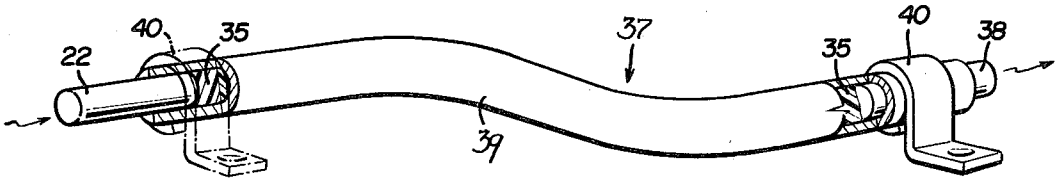
FIG. 3
FIG. 1

ELASTOMER FORCE TRANSMITTER

BACKGROUND OF THE INVENTION

It has heretofore been difficult for a machinist to hold an irregularly-shaped part on a work table for drilling a hole, planing or finishing its surfaces, or performing other machining and work operations on the part. Typically, an irregularly-shaped part is held against the work table by a hydraulically-operated or pneumatically-operated clamp device which may have sophisticated and costly pumps, control valves, pressurized fluid lines, and pressure plates. These known clamping and holding devices are unacceptable for securing irregularly-shaped parts on a work table because they are expensive, and because of their complexity, they require excessive set-up time and effort by the machinist.

It is also known that hydraulically-actuated clamping or holding mechanisms can be unacceptable because the hydraulic fluid leaks onto the work surface thereby creating a nuisance. A problem sometimes encountered using a hydraulically-actuated clamping mechanism is that the hydraulic fluid leaks around the joints and couplings of the pressurized fluid lines. In certain machining operations, it is not suitable for hydraulic fluid to be on the work surface because it attracts and retains metal shavings and other undesirable materials that only hinder subsequent machining operations.

Pneumatically-operated or spring-biased clamps are other known devices for holding down irregularly-shaped parts; and while they do not cause a nuisance such as that found in the use of hydraulically-actuated clamps, they are not without their own problems. Pneumatically-actuated clamps use high pressure air lines that necessitate use of a compressor and other complicated and expensive apparatus for actuating the pressure members of the clamp. Spring biased clamps use springs, cams, and other mechanical parts that are susceptible to breakage or mechanical failure.

Another problem with prior clamping devices is that they require complex and expensive elements such as control valves to actuate and return the pressure-applying members that abut the irregularly-shaped part. Normally, a control valve is required in the pneumatic or hydraulic pressure lines to cause the pressure-applying members to be extended as well as retracted. An equivalent device is also required for the mechanical, spring-biased type clamps. The cost of having these in-line controls is undesirable, and there is always the problem of malfunctioning and mechanical failure.

Hence, the invention herein is concerned with, but not limited to, an improved motion and pressure transferring device for holding irregularly-shaped parts on a work table for machining and working operations.

SUMMARY OF THE INVENTION

The invention herein relates to the transmission of pressure and movement by a solid, substantially incompressible elastomeric material. A container, having openings, is filled with the elastomeric material and movable closures abut the material in the container openings. Pressure and movement applied to the elastomeric filler by one movable closure is transmitted to a second movable closure.

The invention herein further relates to a simplified clamping device for holding a regularly-shaped or irregularly-shaped part on a work table so that a machinist can perform machining and work operations on the part. The clamping device has a housing with an interior cavity that is filled with a substantially non-compressible elastomeric material such as polyurethane. The housing of the clamping device is secured by hold-down fastening bolts to a work table. An opening into the interior cavity accommodates a disk-like pressure plate that abuts a surface of the elastomeric material, and a plurality of sleeves are formed in the housing which extend radially outwardly of the interior cavity of the housing.

A plurality of plungers abut the elastomeric material at one of their ends interior of the housing, and the plungers are slidable in the sleeves that are formed as part of the housing. The plungers are selectively extended radially outwardly when pressure and movement are applied to the elastomeric material by a threaded collar that turns down on the disk-like pressure plate. The free ends of the plungers, which are outside the housing, directly engage the part, or through extender tubes, they cause other pressure-applying plungers to engage the part.

An important part of the present invention resides in the use of a substantially incompressible, elastomeric material, such as polyurethane, for the pressure and movement transmitting medium. Unlike hydraulically or pneumatically-actuated clamps, which use fluids, the clamp of the present invention does not leak because the pressure-transmitting elastomeric material is a solid substance. The precise tolerances, required in constructing known hydraulically or pneumatically-actuated clamps, are not required in the construction of the clamping device in the present invention because the elastomeric material will not leak. This reduces the cost of producing a clamp in accordance with the teachings of the present invention.

The clamping device of the present invention is substantially simplified over prior constructions in that the only elements necessary for an operative device are a housing with an interior cavity filled with elastomeric material, a plurality of plungers bonded to or abutted against the elastomeric material which are free to move radially outwardly of the housing, and a pressure-applying apparatus.

As taught by the present invention, a simple mechanical apparatus, such as a threaded collar and pressure plate arrangement, can be used to apply pressure against the elastomeric material contained in the interior cavity of the clamping device. By turning down the threaded collar against the pressure plate, which abuts the elastomeric material, the elastomeric material is slightly compressed causing the plungers, to be extended radially outwardly from the clamp. Thus, the elastomeric material transmits to the plungers the pressure and movement exerted against it by the threaded collar and pressure plate apparatus. This eliminates the need for known complicated and expensive actuation apparatus as well as the controls for such apparatus.

The present invention also eliminates the need for complex and expensive controls for plunger retraction because of the "memory" characteristic of the elastomeric material. To retract the plungers, the threaded collar and pressure plate are backed off, thereby relieving the pressure on the elastomeric material. The plungers are automatically retracted within the clamp because the memory of the elastomeric material returns it to its uncompressed state when the pressure is removed. Unlike known clamping devices, which require control valves and other complex apparatus to retract the plungers, the machinist using the clamp of the present invention merely releases the pressure on the elastomeric material, and the plungers will be automatically withdrawn into the housing.

The present invention also contemplates extender tubes which bridge the gap between the free ends of the plungers in the clamping device and the surface of the part. The extender tubes are, for example, seamless, flexible tubes substantially filled with elastomeric material, and they have part-engaging plungers at one end bonded to the elastomeric material such that the part-engaging plungers are extended against and retracted from the part when pressure is applied to the elastomeric material at the other end of the extender tube. The extender tubes are mounted onto the plungers emanating from the clamp housing, and when the clamp plungers are extended radially outwardly, the part engaging plungers are likewise extended outward from the extender tubes against the part. The extender tubes can be bent or cut to size as desired.

The advantage provided by the extender tubes is that after the machinist has secured the clamping device to the work table, it is a simple task to mount the extender tubes onto the free ends of the plungers emanating from the clamping device. The extender tubes are bent or cut to reach the closest surface of the part.

These and other objects and advantages of this invention will become apparent upon reading the following description, of which the attached drawings form a part.

DESCRIPTION OF THE DRAWING

FIG. 1 is a perspective view of the clamping device of the present invention;

FIG. 2 is a cross-sectional view of the clamping device and extender tube combination mounted on a work table and holding a part; and FIG. 3 is a perspective view of an extender tube with portions cut-away for interior viewing.

DETAILED DESCRIPTION OF THE INVENTION

Referring to FIGS. 1 and 2, a clamping device 10, constructed in accordance with the teachings of the present invention, holds an irregularly-shaped part 11 against a flat bed work table 12 for machining or other work operations. The irregularly-shaped part 11 is formed in a mold, for example, and it has an irregular, donut-like shape. The clamping device 10 of the present invention can hold any part having an interior hole irrespective of its surface contour. As will be subsequently explained, it is also within the scope of the present invention to provide a clamping device 10 for clamping any solid part having either a regular or an irregular shape. It is also contemplated that the teachings of the present invention can be used in apparatus other than clamping devices.

The clamping device 10 shown in FIGS. 1 and 2 comprises a housing 14 having an interior cavity 15 filled with a substantially incompressible elastomeric material 17 such as polyurethane, and the housing is fastened to the work table 12 by hold-down bolts 18 which fit through holddown tabs 19. The elastomeric material 17 is solid, and therefore, it will not leak from the clamping device onto the work surface 20. The use of elastomeric material as a pressure and movement transmitting medium eliminates pressure and fluid losses from joints and couplings which are typically encountered when using known hydraulically or pneumatically-actuated clamping devices.

The non-compressible elastomeric material may vary depending upon what is commercially available and the cost thereof. An example of such a suitable material is a polyurethane identified as Dupont L-100, which is a polyurethane pre-polymer to which Dupont "MOCA" curing agent is added. Approximately 88% of L-100, by weight, is mixed with 12% of the "MOCA" and cured for about 5 minutes at about 220° F. under vacuum. This a known commercially available material.

The elastomeric material 17 reliably transmits pressure and movement exerted against it without the need for complex and expensive control apparatus, and because of its memory characteristic, the material returns to its static state after pressure has been released. The present invention teaches the use of elastomeric material as a pressure and movement transmitting medium which can be used in many applications that are not practicable with known pressure transmitting fluids such as air and oil. An example of an application for the elastomeric material is found in the clamping device of the present invention, to be described.

Referring to the drawing, the clamp housing 14 has a plurality of sleeve openings 21 formed therein which house a plurality of equally sized plungers 22 for slidable movement therein. Each plunger 22 is bonded to or abutted against the elastomeric material 17 at its interior end, and when pressure is exerted against the elastomeric material 17, the plungers 22 move radially outwardly from the housing 14 within sleeves 21.

When the pressure and movement exerted against elastomeric material 17 is removed, the memory of the elastomeric material returns the plungers 22 to their original non-extended position within the housing 14. Any pressure and movement imposed on the elastomeric material 17 is transmitted to the plungers 22, and thus, the present invention provides pressure and movement transmission to the pluners without using the complex and expensive pumps, control valves, pressurized fluid lines, and pressure plates required when using hydraulically or pneumatically-actuated clamping devices. The plungers 22 can directly engage the part 11 to be held against the work table 12, or as will be subsequently explained, they can be used as pressure applying members in extender tubes to force other plungers against the part.

Pressure and movement may be applied to the elastomeric material 17 contained in the interior cavity 15 of housing 14 by many different mechanical pressure applying apparatus including the threaded collar 25 and pressure plate 26 (FIG. 2) arrangement shown in the drawing. The disk-like pressure plate 26 slidably fits into an opening 27 of the housing 14, and one of its surfaces 28 abuts and is bonded to the elastomeric material 17 while an opposite surface 29 is abutted by the bottom surface of the threaded collar 25.

The threaded collar 25 is turned by a knob 30 mounted on its top end. The threaded collar 25 is supported above the pressure plate 26 by a support housing 31 fixed to the top of the clamp housing 14, and it has a threaded opening 32 which matingly engages the threaded collar 25. Clockwise turning of knob 30 turns down the threaded collar 25 against the pressure plate 26 and thereby exerts pressure and movement against elastomeric material 17. Counterclockwise turning of knob 30 releases the pressure exerted by threaded collar 21 against pressure plate 18. Pressure and movement exerted by the pressure plate 18 against elastomeric material 17 results in radially outward extension of the plungers 22 from the housing 14 whereas removal of the pressure permits the elastomeric material to automatically retract the plungers 19 into the housing 14 because of its memory. Other apparatus for applying pressure and movement to the elastomeric material is within the scope of the present invention.

In operation, the machinist places part 11 on the work table 12 and turns down the threaded collar 25 against pressure plate 26 and elastomeric material 17. The plungers 22 automatically extend radially outwardly against elastomeric material 35 in the extender tubes 37 thereby forcing part-engaging plungers 38 into clamping engagement with the part 11. After a work operation on the part is completed, the threaded collar 25 is backed off and the memory of the elastomeric material 17 and 35 retracts the plungers 22 and 38, respectively, into the housing 14 and into the extender tubes 37.

The clamping device 10 of the present invention is intentionally fabricated with short plungers 22 emanating from the housing 14. Because the contour of the irregularly-shaped part 11 is variable, it is desirable that the clamping device be capable of holding any irregularly or regularly shaped part that is placed on the work table for a machining operation. Thus, the present invention also contemplates the use of extender tubes 37 for bridging the gap between the free ends of the plungers 22 and the surface of the irregularly-shaped part 11.

Referring to FIG. 3, the extender tubes 37 can be seamless, flexible tubes 39 made from aluminum, for example, and substantially filled with an elastomeric material 35, and they have part-engaging plungers 38 at one end bonded to the elastomeric material 35. Like the clamping device 10, when pressure and movement are exerted against the elastomeric material 35 in extender tubes 37 by plungers 22, the part-engaging plungers 38 are extended outwardly against the part 11, and when the pressure is removed, the memory of the elastomeric material 35 retracts the plungers 38 away from the part and into the extender tubes 37.

As shown in FIGS. 2 and 3, the extender tubes 37 are mounted onto the plungers 22 emanating from the clamp housing 14. The tubes are fabricated in a variety of lengths, and are cut to a length corresponding to the distance between the free ends of the plungers 22 and the part 11, or alternatively, the extender tubes are bent to bridge the distance as illustrated in FIG. 3. Tube clamps 40 (FIG. 3) are used, when needed, to hold the extender tubes in place, and they may be secured to the work table 12 by conventional means. One of the advantages provided by the extender tubes is that the machinist can clamp a part having any irregular surface by maneuvering the part on the work table and either cut or bend the extender tubes to reach the surface of the part.

For solid parts of irregular shape without the donut-like hole shown in the drawing, the clamping device of the present invention can be modified such that the clamp housing 14 is substantially donut-shaped and surrounds the part with the plungers 22 extending radially inwardly. The extender tubes 37 can be mounted on the plungers 22 to bridge the gap between the plungers and the part as previously described.

While the present invention has been described for use in clamping irregularly-shaped parts on a work table, it has equal application as a clamping device for any part having a regular or an irregular surface. Additionally, the principle taught herein with regard to elastomeric material being used for pressure and movement transmission has application to other apparatus where it is desired to actuate a remotely located pressure member.

It will be apparent to those skilled in the art that the foregoing disclosure is exemplary in nature rather than limiting, the invention being limited only by the appended claims.

I claim:

1. In a clamping device for fixedly holding a part on a support bed, the improvement comprising:

a housing having an interior cavity filled with an elastomeric material having a memory characteristic, said housing mounted to said support bed;

a pressure member slidably movable in an opening in said housing, said pressure member abutting said elastomeric material on one of its surfaces, and adjustment means for applying pressure and movement to said pressure member abutting said pressure member on another of its surfaces;

at least one plunger slidably movable along a sleeve opening in said housing, said plunger and pressure member being bonded to said elastomeric material;

said adjustment means comprising a threaded collar movable in a support mounted to said housing, said threaded collar being movable in a first direction through an opening in said support against said pressure member causing said pressure member to move inwardly into said housing such that pressure and movement is transmitted by said elastomeric material to said plunger causing said plunger to be extended outwardly of said housing and said threaded collar being movable in a second direction opposite to said first direction such that said plunger being automatically retracted within said housing upon removal of said pressure and movement from said pressure member due to the memory characteristic of said elastomeric material.

2. In a clamping device for fixedly holding a part on a support bed, the improvement comprising:

a housing having an interior cavity filled with an elastomeric material, said housing mounted to said support bed;

a pressure member slidably movable in an opening in said housing, said pressure member abutting said elastomeric material on one of its surfaces, and means for applying pressure and movement to said pressure member on another of its surfaces;

at least one plunger slidably movable along a sleeve opening in said housing, said plunger and pressure member being bonded to said elastomeric material;

whereby pressure and movement applied to said pressure member is transmitted by said elastomeric material to said plunger causing said plunger to be extended outwardly of said housing and said plunger being automatically retracted within said housing upon removal of said pressure and movement from said pressure member;

an extender tube substantially filled with elastomeric material and having a part engaging plunger slidably mounted within one end of said extender tube, said part engaging plunger bonded to said elastomeric material in said extender tube, the other end of said extender tube mounted to said housing and around said plunger of said clamping device whereby outward pressure and movement exerted by said clamping device plunger is transmitted by said elastomeric material of said extender tube causing said part engaging plunger to be extended outwardly of said extender tube.

3. In a clamping device as defined in claim 2 wherein upon removal of pressure and movement from said pressure member, said clamping device plunger and said part engaging plunger being automatically retracted within said housing and said extender tube, respectively, due to the memory characteristic of said elastomeric material.

* * * * *